US010734791B2

(12) United States Patent
Niessner

(10) Patent No.: US 10,734,791 B2
(45) Date of Patent: Aug. 4, 2020

(54) PRE-CHAMBER SPARK PLUG WITH SURFACE DISCHARGE SPARK GAP

(71) Applicant: Federal-Mogul Ignition GmbH, Neuhaus-Schierschnitz (DE)

(72) Inventor: Werner Niessner, Steinheim (DE)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 0 days.

(21) Appl. No.: 16/703,370

(22) Filed: Dec. 4, 2019

(65) Prior Publication Data

US 2020/0185888 A1 Jun. 11, 2020

Related U.S. Application Data

(60) Provisional application No. 62/776,112, filed on Dec. 6, 2018.

(51) Int. Cl.
*H01T 13/02* (2006.01)
*H01T 13/34* (2006.01)
*H01T 13/52* (2006.01)

(52) U.S. Cl.
CPC ..... *H01T 13/02* (2013.01); *H01T 13/34* (2013.01); *H01T 13/52* (2013.01)

(58) Field of Classification Search
CPC ..... H01T 13/02; H01T 13/34; H01T 13/52
See application file for complete search history.

(56) References Cited

U.S. PATENT DOCUMENTS

| | | | | |
|---|---|---|---|---|
| 2,642,054 | A * | 6/1953 | Wright | H01T 13/54 313/143 |
| 9,004,042 | B2 | 4/2015 | Tozzi et al. | |
| 9,929,539 | B2 | 3/2018 | Maul et al. | |
| 2009/0309475 | A1* | 12/2009 | Tozzi | H01T 13/467 313/143 |
| 2011/0148274 | A1 | 6/2011 | Ernst | |
| 2012/0242215 | A1 | 9/2012 | Hwang et al. | |
| 2017/0358906 | A1 | 12/2017 | Kuhnert | |
| 2018/0219356 | A1 | 8/2018 | Jung | |

FOREIGN PATENT DOCUMENTS

DE 10144976 A1 4/2003

* cited by examiner

*Primary Examiner* — Joseph L Williams
(74) *Attorney, Agent, or Firm* — Reising Ethington, P.C.

(57) ABSTRACT

A pre-chamber spark plug for an internal combustion engine having a surface discharge spark gap that is generally located at a rearward end of a pre-chamber and is configured so that sparking components will have minimal electrode obstruction and promote unhindered gas exchange between the pre-chamber and a main combustion chamber. According to one embodiment, the surface discharge spark gap includes a radial sparking portion where a majority of the sparking occurs in a generally radial direction. According to another embodiment, the surface discharge spark gap includes both a radial sparking portion and an axial sparking portion so that sparking occurs in both radial and axial directions, respectively.

19 Claims, 2 Drawing Sheets

PRE-CHAMBER SPARK PLUG WITH SURFACE DISCHARGE SPARK GAP

RELATED APPLICATIONS

This application claims the benefit of U.S. Provisional Application No. 62/776,112, filed Dec. 6, 2018, the entire contents of which are herein incorporated by reference.

FIELD

This invention generally relates to spark plugs, and more particularly, to pre-chamber spark plugs.

BACKGROUND

The successful operation of pre-chamber spark plugs, particularly when used in automotive internal combustion engines, can be dependent on the unobstructed flow of unburnt or fresh gas into a pre-chamber and of burnt or residual gas out of the pre-chamber. If, for example, the burnt or residual gas is not adequately flushed or otherwise expelled from the pre-chamber following the combustion process, irregular and undesirable combustion events can occur. Such events can cause pre-ignition within the main combustion chamber, can increase the temperature of certain spark plug components, and can lead to other undesirable consequences as well.

Thus, it may be desirable to provide a pre-chamber spark plug with improved gas flow into and/or out of the pre-chamber.

SUMMARY

According to one embodiment, there is provided a pre-chamber spark plug, comprising: a metal shell having an axial bore, an end portion with a distal end surface, and an internal protrusion; an insulator at least partially disposed in the axial bore of the metal shell and having an axial bore and an end nose portion with a distal end surface; a center electrode at least partially disposed in the axial bore of the insulator and having an end portion with a distal end surface; and a pre-chamber cap attached to the metal shell and having a pre-chamber wall with one or more orifice(s) that allow for gas flow between a pre-chamber and a main combustion chamber when the pre-chamber spark plug is installed in an engine; wherein the pre-chamber spark plug has a surface discharge spark gap that extends between the distal end surface of the center electrode and the internal protrusion of the metal shell along the distal end surface of the insulator.

According to various embodiments, the pre-chamber spark plug may further include any one of the following features or any technically-feasible combination of some or all of these features:

- the internal protrusion of the metal shell has a radial surface and an internal shoulder on opposite axial sides of the internal protrusion, the radial surface faces the pre-chamber and the internal shoulder supports the insulator;
- the distal end surface of the center electrode is located at an axial position that is beyond, in a forward direction, the distal end surface of the insulator by an axial distance (DA1, DA2) that is from 0 mm-5 mm, inclusive;
- the radial surface of the internal protrusion is located at an axial position that is beyond, in a forward direction, the distal end surface of the insulator by an axial distance (DC1, DC2) that is from 0 mm-5 mm, inclusive;
- the distal end surface of the metal shell is located at an axial position that is beyond, in a forward direction, the radial surface of the internal protrusion, the distal end surface of the insulator, and the distal end surface of the center electrode;
- the radial surface of the internal protrusion is located at an axial position that is beyond, in a forward direction, the distal end surface of the insulator, the distal end surface of the center electrode is located at an axial position that is beyond, in a forward direction, the radial surface of the internal protrusion, and the distal end surface of the metal shell is located at an axial position that is beyond, in a forward direction, the distal end surface of the center electrode;
- the distal end surface of the center electrode is located at an axial position that is beyond, in a forward direction, the distal end surface of the insulator, the radial surface of the internal protrusion is located at an axial position that is beyond, in a forward direction, the distal end surface of the center electrode, and the distal end surface of the metal shell is located at an axial position that is beyond, in a forward direction, the radial surface of the internal protrusion;
- the surface discharge spark gap has a radial sparking portion where a majority of the sparking occurs in a generally radial direction, with respect to a central axis of the spark plug, as opposed to an axial direction;
- the radial sparking portion extends between the center electrode and the internal protrusion along the distal end surface of the insulator over a radial distance (GFS1) that is from 0.5 mm and 3.0 mm, inclusive;
- the surface discharge spark gap also has a surface spark gap where a majority of the sparking occurs along the distal end surface of the insulator, as opposed to an aerial spark gap;
- the surface discharge spark gap has both a radial sparking portion where sparking occurs in a generally radial direction and an axial sparking portion where sparking occurs in a generally axial direction, with respect to a central axis of the spark plug;
- the radial sparking portion extends between the center electrode and the internal protrusion along the distal end surface of the insulator over a radial distance (GFS2) that is from 0.5 mm and 3.0 mm, inclusive, and the axial sparking portion extends between the insulator and the internal protrusion across an aerial spark gap that has an axial distance (LFS2) that is from 0.3 mm and 2.0 mm, inclusive;
- the distal end surface of the insulator is largely a flat, annular surface that extends in a radial direction, with respect to a central axis of the spark plug, so that the distal end surface of the center electrode, the distal end surface of the insulator, and a radial surface of the internal protrusion are all flush or nearly flush with one another;
- the pre-chamber is defined by the pre-chamber wall of the pre-chamber cap on a forward end of the pre-chamber, by the pre-chamber wall of the pre-chamber cap and a pre-chamber wall of the metal shell on sides of the pre-chamber, and by a combination of the distal end surface of the center electrode, the distal end surface of the insulator, and a radial surface of the internal protrusion on a rearward end of the pre-chamber;
- the surface discharge spark gap is located at the rearward end of the pre-chamber and is configured so that sparking components will have minimal electrode obstruction and promote unhindered gas exchange between the pre-chamber and the main combustion chamber; and the pre-chamber spark plug is a passive pre-chamber spark plug and is configured to receive air and fuel only from the main combustion chamber through the one or more orifice(s) in the pre-chamber cap, and not from any additional injectors that direct air or fuel directly inside the pre-chamber.

According to another embodiment, there is provided a method of operating a pre-chamber spark plug. The pre-chamber spark plug comprises: a metal shell having an axial bore and an internal protrusion; an insulator at least partially disposed in the axial bore of the metal shell and having an axial bore and a distal end surface; a center electrode at least partially disposed in the axial bore of the insulator and having a distal end surface; and a pre-chamber cap; wherein the pre-chamber spark plug has a surface discharge spark gap that extends between the distal end surface of the center electrode and the internal protrusion of the metal shell along the distal end surface of the insulator. The method comprises the steps of: applying a voltage to the center electrode; and generating a spark that extends from the center electrode toward the internal protrusion of the metal shell across the surface discharge spark gap.

According to various embodiments, the method may further include and/or incorporate any one of the following features or any technically-feasible combination of some or all of these features:

the generating step may further comprise generating a spark that emanates from the center electrode, and flashes along the distal end surface of the insulator over a radial distance (GFS1) towards the internal protrusion of the metal shell; and the generating step may further comprise generating a spark that emanates from the center electrode, flashes along the distal end surface of the insulator over a radial distance (GFS2), and arcs across an aerial spark gap with an axial distance (LFS2) towards the internal protrusion of the metal shell.

DRAWINGS

One or more embodiments will hereinafter be described in conjunction with the appended drawings, wherein like designations denote like elements, and wherein.

DESCRIPTION

The present application is directed to a pre-chamber spark plug for an internal combustion engine that is designed to improve the flow of unburnt or fresh gas into the pre-chamber and burnt or residual gas out of the pre-chamber. The flow of such gases, particularly the flushing out of burnt gas and corresponding residue, can have a substantial impact on the performance of the spark plug. For instance, if the burnt gas is not completely flushed or purged from the pre-chamber following the combustion process, then the spark plug may experience irregular combustion events in the pre-chamber that can not only lead to increases in the temperature of various spark plug components, but can also cause irregular combustion events in the main combustion chamber. Thus, the pre-chamber spark plug of the present application utilizes a pre-chamber design having minimal electrode obstruction so that an optimum gas exchange between the main combustion chamber and the pre-chamber can be achieved for various engine load and operating conditions, while at the same time maintaining a thermally robust pre-chamber spark plug.

Figure 1:
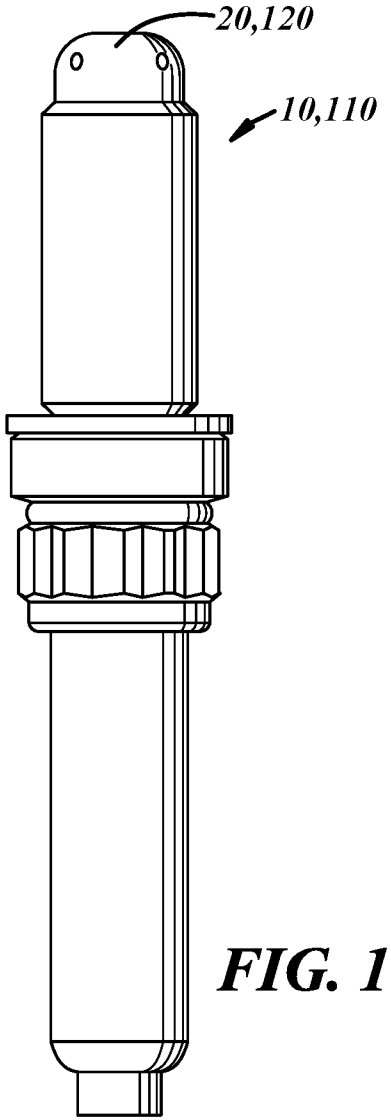
FIG. 1 is view of a pre-chamber spark plug.

FIG. 1 shows an example of a pre-chamber spark plug 10, 110 that generally has a surface discharge spark gap located within a pre-chamber cap 20, 120. The pre-chamber spark plug 10, 110 is not limited to a specific firing end arrangement and may, for example, include the surface discharge spark gap embodiments shown in FIG. 2 or FIG. 3. Other types of surface discharge spark gaps may be used as well.

Figure 2:
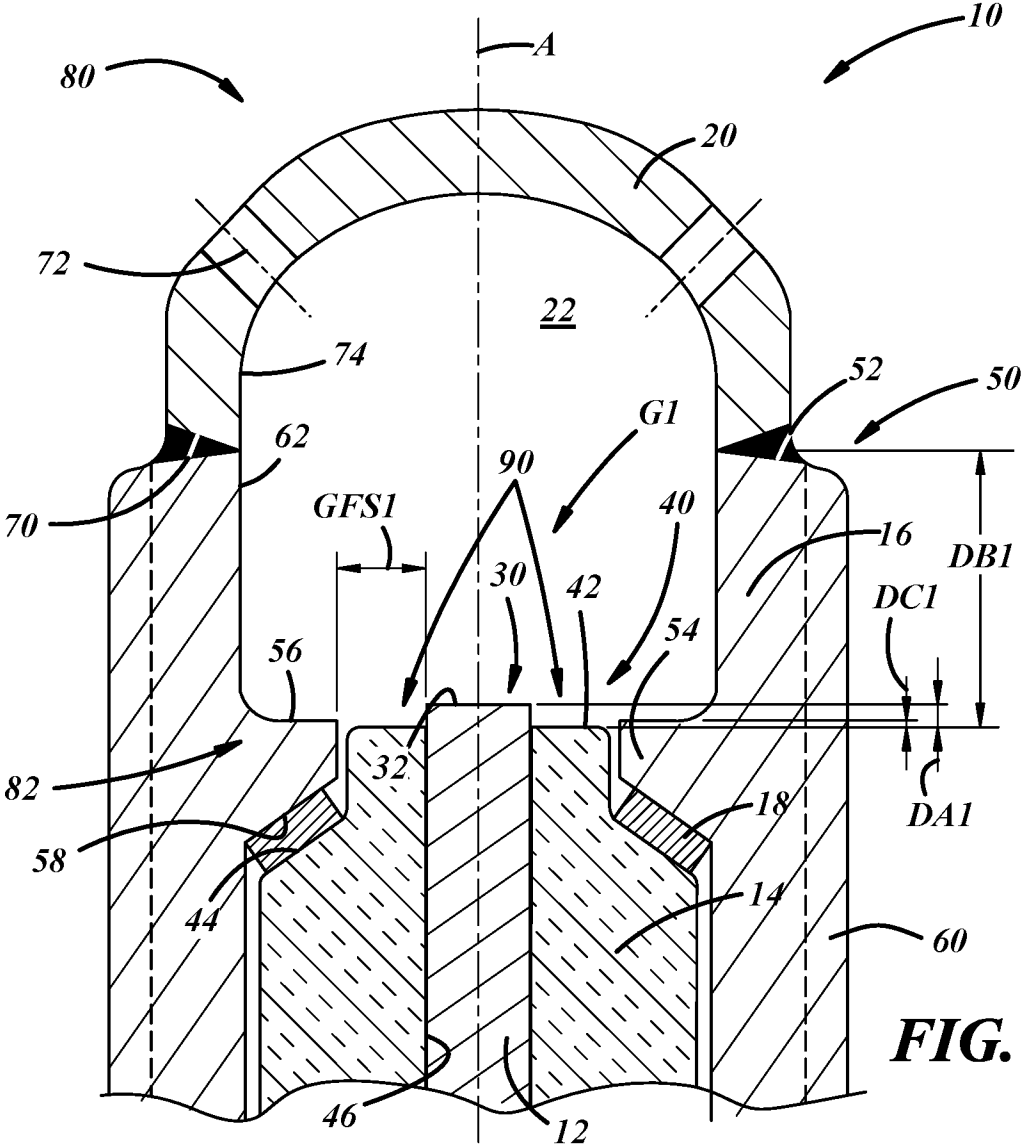
FIG. 2 is an enlarged cross-sectional view of the pre-chamber spark plug of FIG. 1, where the spark plug has a surface discharge spark gap according to a first embodiment.

According to a first embodiment, FIG. 2 shows a portion of a pre-chamber spark plug 10 that includes a center electrode 12, an insulator 14, a metal shell 16, a seal ring 18, a pre-chamber cap 20, a pre-chamber 22, a surface discharge spark gap G1, and a central axis A. Other components not shown here can include a terminal stud, center wire components like resistors and suppressors, as well as various gaskets and seals, all of which are known to those skilled in the art and may be part of spark plug 10. The pre-chamber spark plug 10 is preferably a "passive pre-chamber spark plug," which means that the pre-chamber receives the gases needed for combustion (i.e., an air/fuel mixture) only from the main combustion chamber, as opposed to an "active pre-chamber spark plug," which includes one or more additional air or fuel injectors directly inside the pre-chamber. Although the pre-chamber spark plug 10 is suitable for various automotive internal combustion engines, such as lean burning direct injection gasoline engines, the spark plug of the present application may be used with any number of other engines as well.

The center electrode 12 is at least partially disposed within an axial bore of the insulator 14, and has an end portion 30 with a distal end surface 32 that may or may not be exposed beyond the insulator. The center electrode 12 is designed to conduct or otherwise convey the high voltage ignition pulse from a terminal end of the spark plug to the surface discharge spark gap G1. In one example, the center electrode 12 simply includes a nickel-based material (e.g., pure nickel or a nickel alloy such as Inconnel 600, 601) that constitutes the entire center electrode. In a different example, not shown here, the center electrode 12 includes the nickel-based material mentioned above as an external or cladding portion of the electrode, and a copper-based material (e.g., pure copper or a copper alloy) that serves as an internal, heat conducting core. According to a multi-piece example, not shown here, the center electrode 12 includes a base electrode component made of the nickel-based material mentioned above (with or without the copper core) and one or more additional firing end components welded or otherwise attached near the end portion 30. Firing end components may be made of precious or noble metals, such as platinum-, iridium-, ruthenium- and/or palladium-based materials that can improve the corrosion and/or erosion resistant properties of the electrode, or they made be made of intermediate materials that improve the attachment of the precious or noble metals to the base electrode components.

In the multi-piece example, the distal end surface 32 is part of the firing end component that is welded to base electrode component.

The insulator 14 is at least partially disposed within an axial bore of the metal shell 16, and has an end nose portion 40 with a distal end surface 42, an external shoulder 44, and an axial bore 46. The insulator 14 is made of a material, such as a ceramic material like alumina, that electrically insulates the center electrode 12 from the metal shell 16. Those skilled in the art will appreciate that a number of different types of insulators with various configurations and compositions may be used, including the exemplary embodiments shown in the drawings. According to the example of FIG. 2, the insulator end nose portion 40 extends to an axial position that is slightly short of the center electrode end portion 40, so that an axial distance (DA1) separates the respective distal end surfaces 32, 42. In this particular example, the distal end surface 42 is a flat, annular surface that, when viewed in cross-section (like FIG. 2), extends in a radial direction between the center electrode 12 and the metal shell 16 (i.e., at least a portion of distal end surface 42 is perpendicular to the central axis A). In other examples, however, the distal end surface 42 may be inclined, convex, concave or have some other configuration. The external shoulder 44 is inclined and extends outwardly away from the end nose portion 40 at an angle so that the insulator 14 can be supported on a corresponding shoulder of the metal shell 16 via the seal ring or gasket 18. The axial bore 46 preferably extends the entire axial length of the insulator 14 and accommodates one or more components of the center electrode.

The metal shell 16 has an end portion 50 with a distal end surface 52, an internal protrusion 54 with a radial surface 56 and an internal shoulder 58, external threads 60, and pre-chamber walls 62. The metal shell 16 is preferably made of some type of suitable steel and is designed to retain many of the other spark plug components and to threadably screw into a cylinder head of the internal combustion engine via external threads 60. According to the example shown in FIG. 2, the end portion 50 of the metal shell extends beyond the end portions 30, 40 of the center electrode and insulator, respectively, such that an axial distance (DB1) separates the respective distal end surfaces 52, 42. However, the exact extent of the end portion 50 may vary by embodiment. The internal protrusion 54 plays a substantial role in the pre-chamber spark plug 10, as it both contributes to sparking and also helps support the insulator 14. The diameter of the external threads 60 is dependent on the particular engine in which the spark plug is to be used and, according to some possible embodiments, the external threads are from about M10-M18, inclusive (e.g., the external threads 60 may correspond to an M12 plug).

The internal protrusion 54 helps form the surface discharge spark gap G1 and also provides an internal shoulder 58 for supporting the insulator 14; thus, the internal protrusion 54 is a seal supporting sparking projection. According to the non-limiting embodiment shown in FIG. 2, the internal protrusion 54 is an integral part of the metal shell 16 and, when viewed in cross-section (like FIG. 2), projects radially inwardly from an inner surface of the metal shell. In other embodiments, the internal protrusion 54 may not be an integral part of the metal shell 16, but may include separate, distinct components that are welded or otherwise attached to an inner surface of the shell (e.g., the internal protrusion 54 could include precious metal and/or non-precious metal pieces welded to the interior of the shell). When viewed along the central axis A (this perspective not shown), the internal protrusion 54 may have a continuous, unbroken annular shape (i.e., it continuously surrounds the end nose portion 40 of the insulator 14), or it may have a broken annular shape so as to form a number of individual or discrete internal protrusions (i.e., it discontinuously surrounds the end nose portion 40 of the insulator 14). On a side facing the pre-chamber 22, the internal protrusion 54 may include a radial surface 56 that is flat and, when viewed in cross-section (like FIG. 2), generally extends in a radial direction (i.e., at least a portion of radial surface 56 is perpendicular to the central axis A). It is also possible for the radial surface 56 to be slightly inclined, curved, concave or convex, as opposed to being perfectly flat in the radial direction, and it may be capped, tipped or otherwise provided with noble or precious metal pieces to increase its resistance to corrosion and/or electrical erosion. According to the present example, the radial surface 56 of the internal protrusion 54 extends slightly beyond the end portion 40 of the insulator such that an axial distance (DC1) separates the respective end surfaces 56, 42. In non-limiting examples, axial distances DA1 and/or DC1 may be from 0 mm-5 mm, inclusive, or more preferably from 1 mm-3 mm, inclusive, and DA1 may be greater than DC1. Although the respective axial positions of surfaces 32, 42 and 56 is preferably as described above, it is possible for the insulator distal end surface 42 to axially extend beyond surfaces 32 and/or 56 instead. As illustrated in FIG. 2, the internal shoulder 58 of the internal protrusion 54 is inclined so as to support the exterior shoulder 44 of the insulator 14 through an annular seal ring or gasket 18 such that the insulator is held in place with a gas-tight seal formed for the pre-chamber 22. The size, inclination and/or other characteristics of the interior shoulder 58 may vary depending on the embodiment.

The pre-chamber cap 20 is attached to the end portion 50 of the metal shell 16 so as to form an internal space or volume (i.e., the pre-chamber 22), and has an attachment surface 70, one or more orifices 72, and pre-chamber walls 74. According to one possible embodiment, the attachment surface 70 of the pre-chamber cap is welded to the distal end surface 52 of the metal shell so that the pre-chamber walls 62 and 74 of the metal shell and pre-chamber cap, respectively, come together and help define or delimit the volume of the pre-chamber 22. The pre-chamber cap 20 may include one or more orifices 72 that allow for gas exchange between the main combustion chamber and the pre-chamber 22 (i.e., either the flow of unburnt gas from the main combustion chamber into the pre-chamber, or the flow or expulsion of burnt gas out of the pre-chamber to the main combustion chamber). According to one non-limiting example, pre-chamber cap 20 includes four to seven orifices 72, inclusive, each having a diameter of about 0.6 mm to 1.4 mm, inclusive. Skilled artisans will appreciate that any suitable number of orifices having appropriate sizes, locations, and orientations are possible and that the present application is not limited to the exemplary embodiment.

The pre-chamber 22 is a volume or space that surrounds the surface discharge spark gap G1 so that a gas (e.g., a fuel and air mixture) can first be ignited in the pre-chamber 22 before propagating to the main combustion chamber via the orifice(s) 72. Skilled artisans will appreciate that the pre-chamber 22 may be designed with any number of different configurations, components, volumes, features, etc. in order to promote or manage turbulence, flame front propagation, and other pre-chamber operating parameters; the pre-chamber of the present application is not limited to any particular embodiment. According to the non-limiting example illustrated in FIG. 2, the pre-chamber 22 is a volume or space that is defined by the pre-chamber wall 74 on a forward end 80 of the pre-chamber (i.e., the end of the pre-chamber that extends into the main combustion chamber), by pre-chamber walls 62 and 74 on the sides of the pre-chamber, and by the combination of the distal end surfaces 32, 42 and the radial surface 56 on a rearward end 82 of the pre-chamber (i.e., the end of the pre-chamber that is opposite of the forward end 80). Unlike some conventional pre-chamber spark plugs where one or more ground electrodes extend into the middle of the pre-chamber space, the pre-chamber 22 is designed to have minimal electrode obstruction so as to promote unhindered gas exchange between the main combustion chamber and the pre-chamber, and to promote better thermal characteristics of the spark plug.

Surface discharge spark gap G1 extends between the center electrode 12 and the metal shell 16 and is used to ignite the air/fuel mixture in the pre-chamber 22. According to the illustrated example, the surface discharge spark gap G1 includes a "radial sparking portion" 90 (also referred to as a radial spark gap), which means that a majority of the sparking in this portion occurs in a generally radial direction, with respect to the central axis A. The radial sparking portion 90 is preferably a "surface spark gap" where a majority of the sparking occurs along a surface, as opposed to across an aerial or air gap. That is not to say that the surface discharge spark gap G1 cannot have some sparking in a non-radial direction or across a small air gap (e.g., the air gap between the distal end surface 42 and the radial surface 56), only that the majority of such sparking is expected to be in a radial direction along one or more surfaces. Skilled artisans will appreciate that surface spark gaps sometimes require lower voltages than corresponding aerial spark gaps and can maintain longer sparks; although, this may vary across different engines, operating conditions, etc. In the non-limiting example of FIG. 2, a spark emanates from the end portion 30 of the center electrode 12, flashes over the end nose portion 40 of the insulator 14 (e.g., along the distal end surface 42), and ends at the internal protrusion 54. The radial sparking portion 90 has a radial distance GFS1 (i.e., the distance from an edge of distal end surface 32 to an opposing edge of radial surface 56) that may be between 0.5 mm and 3.0 mm, inclusive, and preferably is between 1.0 mm and 2.0 mm, inclusive. The surface discharge spark gap G1 is located at the rearward end 82 of the pre-chamber 22 so that the sparking components do not obstruct the resulting flame front, which is beneficial for flame propagation and subsequential pressure build up in the pre-chamber 22. In terms of the materials of the spark gap components, the surface discharge spark gap G1 may begin or emanate at a center electrode 12 made of a nickel-based material or a firing end component made of a noble or precious metal, flash over an insulator 14 made of a ceramic material, and terminate at an internal protrusion 54 that is part of a metal shell 16 made of some type of steel. Thus, a nickel/ceramic/steel surface discharge spark gap G1 is possible.

Figure 3:
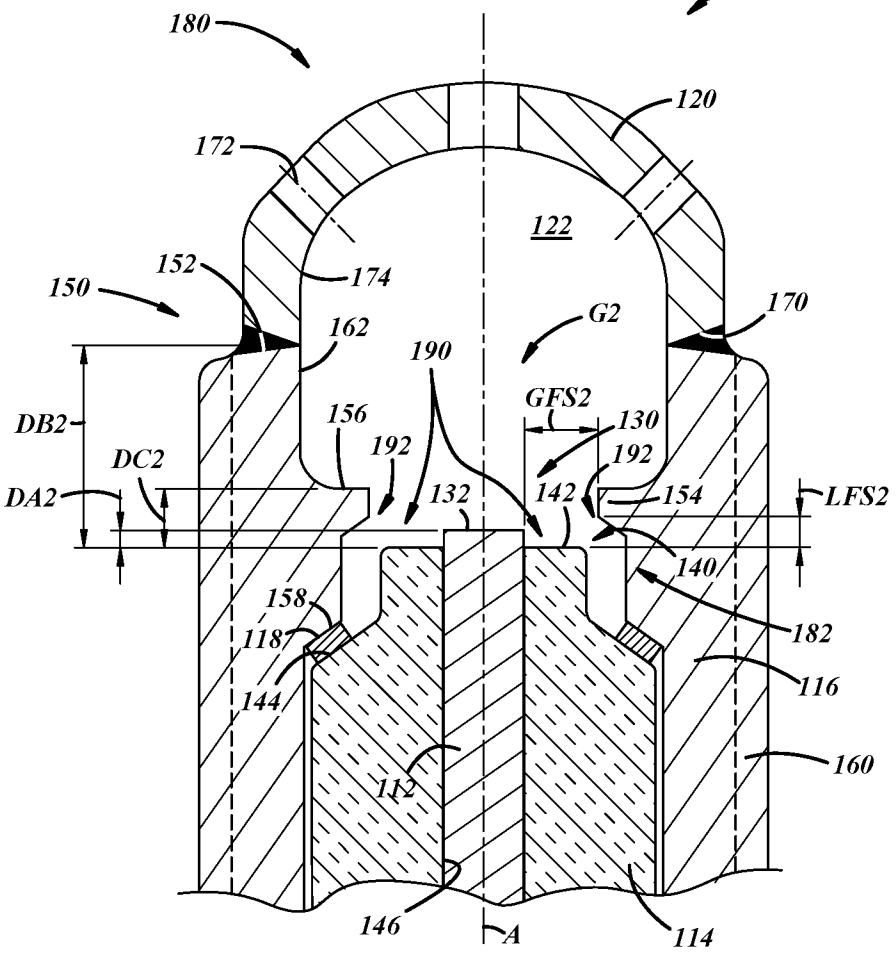
FIG. 3 is an enlarged cross-sectional view of the pre-chamber spark plug of FIG. 1, where the spark plug has a surface discharge spark gap according to a second embodiment.

Turning now to FIG. 3, there is shown another embodiment of a pre-chamber spark plug 110. It should be appreciated that much of the preceding description of pre-chamber spark plug 10 applies to this embodiment as well, unless indicated otherwise. Thus, corresponding reference numerals have been used to describe corresponding components. The pre-chamber spark plug 110 includes a center electrode 112, an insulator 114, a metal shell 116, a seal ring 118, a pre-chamber cap 120, a pre-chamber 122, a surface discharge spark gap G2, and a central axis A. Like the preceding embodiment, pre-chamber spark plug 110 is also a passive pre-chamber spark plug that is suitable for various automotive internal combustion engines, such as lean burning direct injection gasoline engines.

The center electrode 112 includes an end portion 130 with a distal end surface 132. The insulator 114 includes an end nose portion 140, a distal end surface 142, an external shoulder 144, an axial bore 146, and an axial distance DA2. The axial distance DA2, which is between surfaces 132 and 142, may be within the same dimensional ranges as provided for axial dimension DA1. The metal shell 116 has an end portion 150 with a distal end surface 152, an internal protrusion 154 with a radial surface 156 and an internal shoulder 158, external threads 160, pre-chamber walls 162, and axial distances DB2 and DC2. The axial distance DB2, which is between surfaces 152 and 142, may be within the same dimensional ranges as provided for axial dimension DB1. However, as illustrated in FIG. 3, the axial length or extent of the internal protrusion 154 is greater than that of the corresponding component 54 in the embodiment of FIG. 2; distance DC2 may, however, still be within the same dimension ranges as provided for axial dimension DC1. Thus, the axial distance DC2, which is the distance between radial surface 156 and distal end surface 142 is greater than its FIG. 2 counterpart, axial distance DC1. This modification affects the surface discharge spark gap G2, as explained below. The pre-chamber cap 120 includes attachment surfaces 170, one or more orifice(s) 172, and pre-chamber walls 174. Lastly, the pre-chamber 122 has a forward end 180 and a rearward end 182.

The surface discharge spark gap G2 extends between the center electrode 112 and the metal shell 116 and includes both a radial sparking portion 190 and an axial sparking portion 192. One difference between this embodiment and the previous one is that substantial sparking occurs in both radial and axial directions, with respect to the central axis A of the spark plug. The surface discharge spark gap G2 includes both a radial sparking portion 190 that acts as a surface spark gap where sparking occurs along a surface, as well as an axial sparking portion 192 that acts as an aerial spark gap where sparking occurs across an air gap. In the non-limiting example of FIG. 3, a spark emanates from the end portion 130 of the center electrode 112, flashes over the end nose portion 140 of the insulator 114 (e.g., along the distal end surface 142), jumps or arcs across the axial sparking portion 192, and ends at the internal protrusion 154. The radial distance GFS2 of the surface discharge spark gap G2 may be within the same dimensions as provided above for GFS1, and the dimensions of the axial distance LFS2 may be roughly ⅔ of GFS2 (i.e., the radial distance GFS2 may be greater than the axial distance LFS2). For example, the surface discharge spark gap G2 may have a radial distance GFS2 that is from 0.5 mm and 3.0 mm, inclusive, and even from 1.0 mm and 2.0 mm, inclusive, and an axial distance LFS2 that is from 0.3 mm and 2.0 mm, inclusive, and even from 0.6 mm and 1.4 mm, inclusive. Other dimensions are certainly possible. The surface discharge spark gap G2 is located at the rearward end 182 of the pre-chamber 122, and the surface discharge spark gap G2 may begin at a center electrode 112 made of a nickel-based material or a firing end component made of a noble or precious metal, flash over an insulator 114 made of a ceramic material, arc across an air gap, and terminate at an internal protrusion 154 that is part of a metal shell 116 made of some type of steel. Thus, a nickel/ceramic/steel surface discharge spark gap G2 is possible.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A pre-chamber spark plug, comprising:

a metal shell having an axial bore, an end portion with a distal end surface, and an internal protrusion;

an insulator at least partially disposed in the axial bore of the metal shell and having an axial bore and an end nose portion with a distal end surface;

a center electrode at least partially disposed in the axial bore of the insulator and having an end portion with a distal end surface; and a pre-chamber cap attached to the metal shell and having a pre-chamber wall with one or more orifice(s) that allow for gas flow between a pre-chamber and a main combustion chamber when the pre-chamber spark plug is installed in an engine;

wherein the pre-chamber spark plug has a surface discharge spark gap that extends between the distal end surface of the center electrode and the internal protrusion of the metal shell along the distal end surface of the insulator.

2. The pre-chamber spark plug of claim 1, wherein the internal protrusion of the metal shell has a radial surface and an internal shoulder on opposite axial sides of the internal protrusion, the radial surface faces the pre-chamber and the internal shoulder supports the insulator.

3. The pre-chamber spark plug of claim 2, wherein the distal end surface of the center electrode is located at an axial position that is beyond, in a forward direction, the distal end surface of the insulator by an axial distance (DA1, DA2) that is from 0 mm-5 mm, inclusive.

4. The pre-chamber spark plug of claim 2, wherein the radial surface of the internal protrusion is located at an axial position that is beyond, in a forward direction, the distal end surface of the insulator by an axial distance (DC1, DC2) that is from 0 mm-5 mm, inclusive.

5. The pre-chamber spark plug of claim 2, wherein the distal end surface of the metal shell is located at an axial position that is beyond, in a forward direction, the radial surface of the internal protrusion, the distal end surface of the insulator, and the distal end surface of the center electrode.

6. The pre-chamber spark plug of claim 2, wherein the radial surface of the internal protrusion is located at an axial position that is beyond, in a forward direction, the distal end surface of the insulator, the distal end surface of the center electrode is located at an axial position that is beyond, in a forward direction, the radial surface of the internal protrusion, and the distal end surface of the metal shell is located at an axial position that is beyond, in a forward direction, the distal end surface of the center electrode.

7. The pre-chamber spark plug of claim 2, wherein the distal end surface of the center electrode is located at an axial position that is beyond, in a forward direction, the distal end surface of the insulator, the radial surface of the internal protrusion is located at an axial position that is beyond, in a forward direction, the distal end surface of the center electrode, and the distal end surface of the metal shell is located at an axial position that is beyond, in a forward direction, the radial surface of the internal protrusion.

8. The pre-chamber spark plug of claim 1, wherein the surface discharge spark gap has a radial sparking portion where a majority of the sparking occurs in a generally radial direction, with respect to a central axis of the spark plug, as opposed to an axial direction.

9. The pre-chamber spark plug of claim 8, wherein the radial sparking portion extends between the center electrode and the internal protrusion along the distal end surface of the insulator over a radial distance (GFS1) that is from 0.5 mm and 3.0 mm, inclusive.

10. The pre-chamber spark plug of claim 8, wherein the surface discharge spark gap also has a surface spark gap where a majority of the sparking occurs along the distal end surface of the insulator, as opposed to an aerial spark gap.

11. The pre-chamber spark plug of claim 1, wherein the surface discharge spark gap has both a radial sparking portion where sparking occurs in a generally radial direction and an axial sparking portion where sparking occurs in a generally axial direction, with respect to a central axis of the spark plug.

12. The pre-chamber spark plug of claim 11, wherein the radial sparking portion extends between the center electrode and the internal protrusion along the distal end surface of the insulator over a radial distance (GFS2) that is from 0.5 mm and 3.0 mm, inclusive, and the axial sparking portion extends between the insulator and the internal protrusion across an aerial spark gap that has an axial distance (LFS2) that is from 0.3 mm and 2.0 mm, inclusive.

13. The pre-chamber spark plug of claim 1, wherein the distal end surface of the insulator is largely a flat, annular surface that extends in a radial direction, with respect to a central axis of the spark plug, so that the distal end surface of the center electrode, the distal end surface of the insulator, and a radial surface of the internal protrusion are all flush or nearly flush with one another.

14. The pre-chamber spark plug of claim 1, wherein the pre-chamber is defined by the pre-chamber wall of the pre-chamber cap on a forward end of the pre-chamber, by the pre-chamber wall of the pre-chamber cap and a pre-chamber wall of the metal shell on sides of the pre-chamber, and by a combination of the distal end surface of the center electrode, the distal end surface of the insulator, and a radial surface of the internal protrusion on a rearward end of the pre-chamber.

15. The pre-chamber spark plug of claim 14, wherein the surface discharge spark gap is located at the rearward end of the pre-chamber and is configured so that sparking components will have minimal electrode obstruction and promote unhindered gas exchange between the pre-chamber and the main combustion chamber.

16. The pre-chamber spark plug of claim 1, wherein the pre-chamber spark plug is a passive pre-chamber spark plug and is configured to receive air and fuel only from the main combustion chamber through the one or more orifice(s) in the pre-chamber cap, and not from any additional injectors that direct air or fuel directly inside the pre-chamber.

17. A method of operating a pre-chamber spark plug, the pre-chamber spark plug comprising: a metal shell having an axial bore and an internal protrusion; an insulator at least partially disposed in the axial bore of the metal shell and having an axial bore and a distal end surface; a center electrode at least partially disposed in the axial bore of the insulator and having a distal end surface; and a pre-chamber cap; wherein the pre-chamber spark plug has a surface discharge spark gap that extends between the distal end surface of the center electrode and the internal protrusion of the metal shell along the distal end surface of the insulator, the method comprising the steps of: applying a voltage to the center electrode; and generating a spark that extends from the center electrode toward the internal protrusion of the metal shell across the surface discharge spark gap.

18. The method of claim 17, wherein the generating step further comprises generating a spark that emanates from the center electrode, and flashes along the distal end surface of the insulator over a radial distance (GFS1) towards the internal protrusion of the metal shell.

19. The method of claim 17, wherein the generating step further comprises generating a spark that emanates from the center electrode, flashes along the distal end surface of the insulator over a radial distance (GFS2), and arcs across an aerial spark gap with an axial distance (LFS2) towards the internal protrusion of the metal shell.

* * * * *